US007896398B2

(12) United States Patent
Suda et al.

(10) Patent No.: US 7,896,398 B2
(45) Date of Patent: Mar. 1, 2011

(54) PIPE HANDLE AND CLEANING DEVICE USING THE SAME

(75) Inventors: Tomokazu Suda, Kagawa (JP); Masatoshi Fujiwara, Kagawa (JP)

(73) Assignee: Uni-Charm Corporation, Shikokuchuo-shi (JP)

( * ) Notice: Subject to any disclaimer, the term of this patent is extended or adjusted under 35 U.S.C. 154(b) by 0 days.

(21) Appl. No.: 11/142,236

(22) Filed: Jun. 2, 2005

(65) Prior Publication Data

US 2005/0285387 A1 Dec. 29, 2005

(30) Foreign Application Priority Data

Jun. 28, 2004 (JP) ..... 2004-190186

(51) Int. Cl.
*A47L 9/24* (2006.01)

(52) U.S. Cl. ..... 285/7; 482/35

(58) Field of Classification Search ..... 285/7, 399, 285/403; 482/35
See application file for complete search history.

(56) References Cited

U.S. PATENT DOCUMENTS

| | | | | |
|---|---|---|---|---|
| 2,142,149 | A * | 1/1939 | Replogle | 285/7 |
| 2,245,151 | A * | 6/1941 | Martinet | 285/7 |
| 2,660,457 | A * | 11/1953 | Mallon | 285/7 |
| 3,476,413 | A | 11/1969 | Coberly | |
| 3,614,143 | A * | 10/1971 | Stevens | 403/334 |
| 3,830,008 | A * | 8/1974 | Johnson | 43/18.1 CT |
| 4,181,230 | A * | 1/1980 | Acuff | 211/208 |
| 4,318,228 | A * | 3/1982 | Kimura | 33/809 |
| 4,437,480 | A * | 3/1984 | Husa | 135/74 |
| 4,627,146 | A * | 12/1986 | Ward | 29/458 |
| 4,769,897 | A * | 9/1988 | Moseman | 29/525 |
| 4,819,969 | A * | 4/1989 | Williams | 285/148.23 |
| 5,090,837 | A * | 2/1992 | Mower | 403/334 |
| 5,343,587 | A * | 9/1994 | Findley | 15/228 |
| 5,462,380 | A * | 10/1995 | Peek et al. | 403/329 |
| 5,511,831 | A * | 4/1996 | Barton | 285/382 |
| 5,667,329 | A * | 9/1997 | Yoder, Jr. | 403/327 |
| 5,685,044 | A * | 11/1997 | Lavis et al. | 15/415.1 |
| 6,209,729 | B1 * | 4/2001 | Brouillard | 210/470 |
| 6,263,895 | B1 * | 7/2001 | Bang | 135/138 |
| 6,343,890 | B1 * | 2/2002 | Benson | 403/329 |

(Continued)

FOREIGN PATENT DOCUMENTS

GB 1390154 A 4/1975

(Continued)

OTHER PUBLICATIONS

Japanese Notification of Reason(s) for Refusal mailed Sep. 29, 2009, directed at counterpart Japanese Application No. 2004-190186; 3 pages.

*Primary Examiner* — Aaron Dunwoody
(74) *Attorney, Agent, or Firm* — Morrison & Foerster LLP

(57) ABSTRACT

Disclosed is a pipe handle including first and second pipes which are engaged together with a male coupling of the second pipe fitted into a female coupling of the first pipe. The first pipe has a larger inside diameter in the female coupling than in a main body adjacent to the female coupling. The second pipe has a continuous outer surface without any step between the male coupling and a main body adjacent to the male coupling. The main body of the first pipe and the main body of the second pipe has an equal or almost equal outside diameter.

2 Claims, 4 Drawing Sheets

U.S. PATENT DOCUMENTS

| | | | |
|---|---|---|---|
| 2003/0007830 | A1 | 1/2003 | Bang |
| 2003/0110584 | A1 | 6/2003 | Clare |
| 2003/0135955 | A1 | 7/2003 | Dove |

FOREIGN PATENT DOCUMENTS

| | | |
|---|---|---|
| JP | 42-8298 | 4/1967 |
| JP | 48-96763 | 11/1973 |
| JP | 49-5911 | 1/1974 |
| JP | 63-201440 | 12/1988 |
| JP | 2002-005135 | 1/2002 |
| JP | 2002-081420 | 3/2002 |
| WO | WO-98/11812 | 3/1998 |
| WO | WO-98/23199 | 6/1998 |

* cited by examiner

PIPE HANDLE AND CLEANING DEVICE USING THE SAME

BACKGROUND OF THE INVENTION

1. Field of the Invention

The present invention relates to a pipe handle formed by coupling a plurality of pipes and to a cleaning device having the pipe handle and a head.

2. Description of the Related Art

There have been known cleaning devices composed of a pipe handle and a head connected to one end of the pipe handle. Cleaning devices of this type are typically used with a disposable cleaning sheet (e.g., a wiper of nonwoven fabric) attached to the head. When used for cleaning the house floor or the like, the pipe handle need be so long that the head can slide on the floor surface with a grip (the other end of the pipe handle) being held by hand.

Japanese Unexamined Patent Publication Nos. 2002-005135 and 2002-081420 disclose pipe handles which are constructed by coupling a plurality of pipes to have a certain length.

Firstly, they disclose coupling between a larger diameter pipe and a smaller diameter pipe, wherein one end of the smaller diameter pipe fits in one end of the larger diameter pipe.

In this case, however, the smaller diameter pipe may be too thin to withstand a bending stress during use, particularly when the pipe handle is constructed of three or more pipes. The bending stress exerted on such a long object is proportional to the bending moment and is inversely proportional to the modulus of section, but in case where the pipe wall thickness is constant, the modulus of section decreases as the outside/inside diameter decreases. Therefore, the use of the smaller diameter pipe may increase the bending stress due to the bending moment during cleaning, which lowers the bending strength.

Secondly, they disclose that a male coupling (or male side end part) of one pipe diametrically contracts toward a distal end to have two-stage tapered outer surface, a proximal second tapered outer surface having a steeper gradient than a distal first tapered outer surface, and a female coupling (or female side end part) of the other pipe has a tapered inner surface whose gradient is equal to that of the first tapered outer surface so that the two pipes can be coupled together by fitting the tapered inner surface of the female coupling over the first tapered outer surface of the male coupling.

In this case, however, since the pipe has to be circumferentially contracted to produce the first and second tapered outer surfaces, the pipe wall thickness tends to vary in the contracted portion, which makes it difficult to hold dimensions of the first tapered outer surface to close tolerance. If the dimensions of the first tapered outer surface cannot be held to close tolerance, insertion of the male coupling into the female coupling will be difficult due to tightness or the male coupling will wobble within the female coupling due to looseness. In addition, such contracting, which is typically performed by clamping and deforming a pipe end between rolls, requires an expensive processing equipment for holding the dimensions to close tolerance and requires some experience, which also results in high cost.

Moreover, since the first tapered outer surface, which is formed by diametrically contracting the male side end part, has a relatively small diameter, the strength against bending moment decreases as set forth above. Furthermore, the first tapered outer surface formed by diametrically contracting the pipe tends to fatigue due to residual stress. Therefore, if the bending stress concentrates in the connection between the pipes during cleaning, bending or cracking tends to occur in the first tapered outer surface.

Japanese Unexamined Patent Publication No. 2002-005135 further discloses a sleeve which is to be located around the male and female couplings of the two pipes. Coupling between the two pipes can be maintained by fitting an engaging projection, which is formed on an inner surface of the sleeve, into both an engaging hole of the male coupling and an engaging hole of the female coupling.

In order to fit the engaging projection into the engaging holes, the sleeve need be slid on the pipe after coupling. However, as the sleeve is slid on the pipe, the engaging projection also comes into contact with the pipe to resist sliding. In addition, it is impossible to visually confirm whether the engaging projection has fitted in the engaging holes from the outside.

SUMMARY OF THE INVENTION

The present invention has been developed to solve the problems in the prior art set forth above and has an object to provide a pipe handle which enables high precision coupling with sufficient strength to withstand bending stress during use and a cleaning device using the same.

According to the present invention, there is provided a pipe handle comprising first and second pipes which are engaged together with a male coupling of the second pipe fitted into a female coupling of the first pipe, the first pipe having a larger inside diameter in the female coupling than in a main body adjacent to the female coupling, the second pipe having a continuous outer surface without any step between the male coupling and a main body adjacent to the male coupling, the main body of the first pipe and the main body of the second pipe having an equal or almost equal outside diameter.

The main bodies of the first and second pipes constituting the pipe handle according to the present invention may have the same outside/inside diameter. In addition, the female coupling may be formed by diametrically expanding the first pipe, which results in high precision diameter as compared with the case where a male coupling is formed by diametrically contracting a pipe. Moreover, both the male and female couplings may have sufficient strength to withstand bending moment.

According to one embodiment of the present invention, the continuous outer surface of the second pipe may have a constant outside diameter. In this case, the male coupling may be formed without deforming the second pipe at all.

Alternatively, the male coupling of the second pipe may have a tapered outer surface whose outside diameter gradually decreases from a boundary between the main body and the male coupling to a distal end of the male coupling and an angle formed between the tapered outer surface of the male coupling and an outer surface of the main body may be equal to or less than 0°50' (0 degrees 50 minutes). The tapered outer surface facilitates insertion of the male coupling into the female coupling. In addition, if the gradient of tapered outer surface is equal to or less than 0°50', the male coupling can be effectively prevented from wobbling due to looseness.

In this embodiment, furthermore, the female coupling of the first pipe may have a tapered inner surface whose inside diameter gradually increases toward a distal end of the female coupling and an angle formed between the tapered inner surface of the female coupling and an inner surface of the main body may be equal to or less than 0°50'. This further facilitates insertion of the male coupling into the female coupling and prevents the male coupling from wobbling due to looseness.

According to one embodiment of the present invention, the first pipe may have an intermediate part which provides a step between an inner surface of the female coupling and an inner surface of the main body, the intermediate part may have a tapered inner surface whose inside diameter gradually increases from the inner surface of the main body to the inner surface of the female coupling, and an angle formed between the tapered inner surface of the intermediate part and the inner surface of the main body may be larger than an angle formed between the inner surface of the female coupling and the inner surface of the main body. The intermediate part, whose tapered inner surface has a steeper gradient than that of the female coupling, may function as a stopper because the distal end of the male coupling can abut against the inner surface of the intermediate part when the male coupling is inserted into the female coupling.

Preferably, an engaging member, which is adapted to fit in both an engaging hole of the female coupling and an engaging hole of the male coupling for maintaining coupling between the first and second pipes, is provided inside the male coupling of the second pipe. The engaging member may be fitted in the engaging hole of the female coupling only by inserting the male coupling into the female coupling. The engagement may be visually confirmed from the outside.

According to the present invention, there is also provided a cleaning device comprising the above-mentioned pipe handle and a head connected to one end of the pipe handle for attachment of a cleaning sheet.

BRIEF DESCRIPTION OF THE DRAWINGS

The present invention will be understood more fully from the detailed description given hereinafter and from the accompanying drawings of the preferred embodiment of the present invention, which, however, should not be taken to limit the invention, but are for explanation and understanding only.

In the drawings.

DESCRIPTION OF THE PREFERRED EMBODIMENT

The present invention will be discussed hereinafter in detail in terms of the preferred embodiment according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscuring of the present invention.

Figure 1:
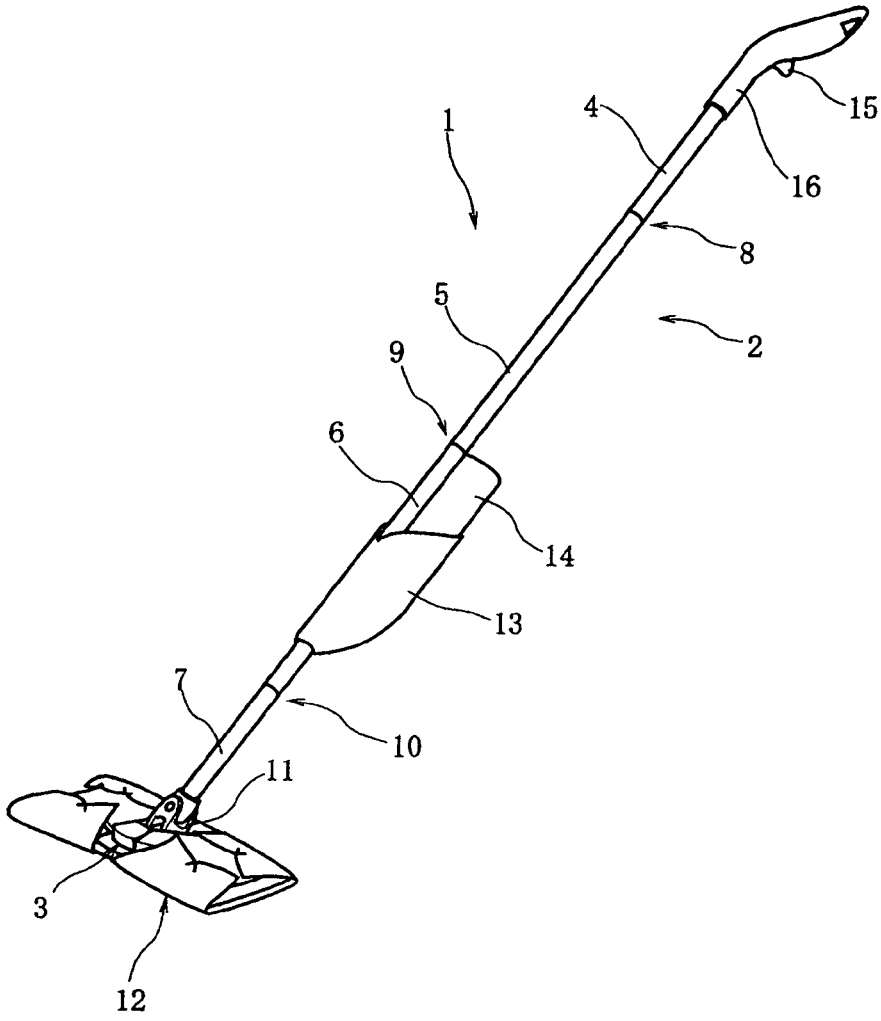
FIG. 1 is a perspective view of a cleaning device employing a pipe handle according to one embodiment of the present invention.
Figure 2:
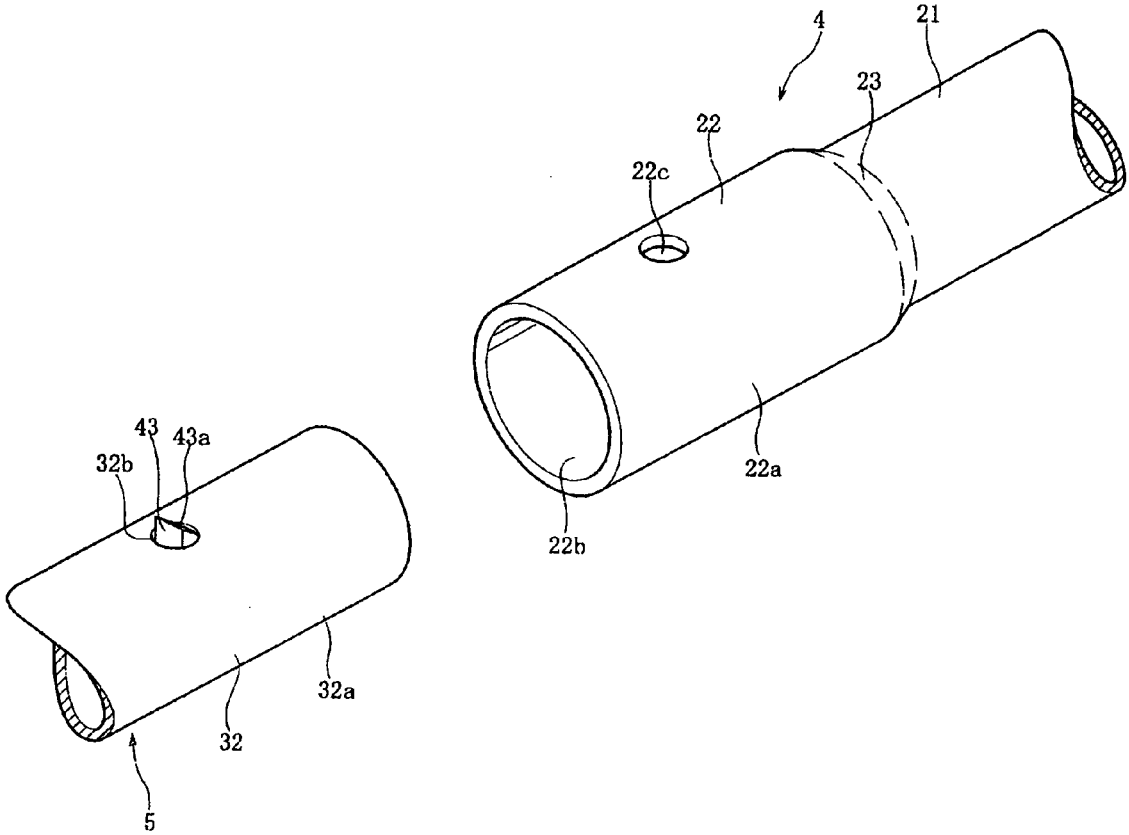
FIG. 2 is an exploded perspective view showing a connection of the pipe handle according to an embodiment of the invention.
Figure 3A:
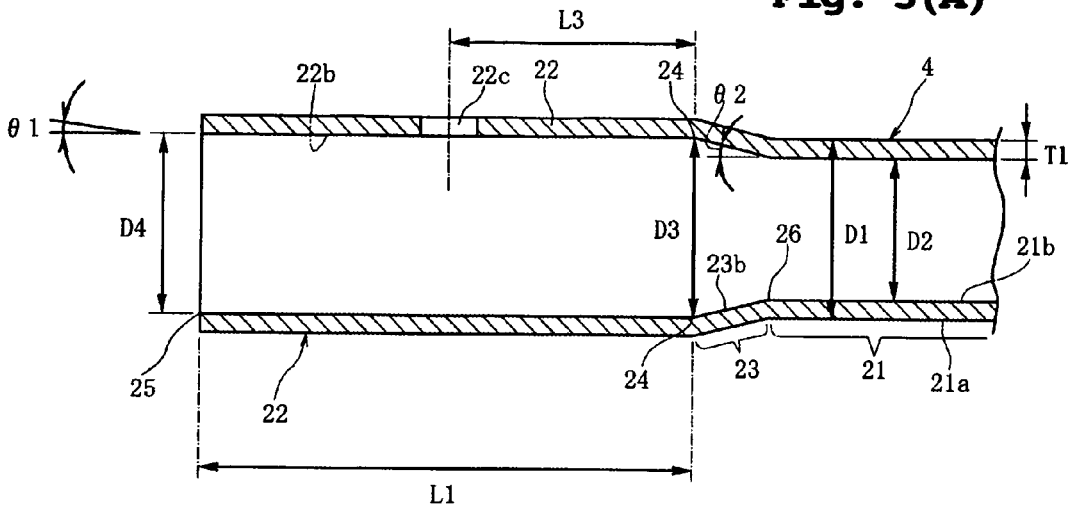
FIG. 3(A) is a sectional view of a female coupling of a first pipe and FIG. 3(B) is a sectional view of a male coupling of a second pipe according to an embodiment of the invention.
Figure 3B:
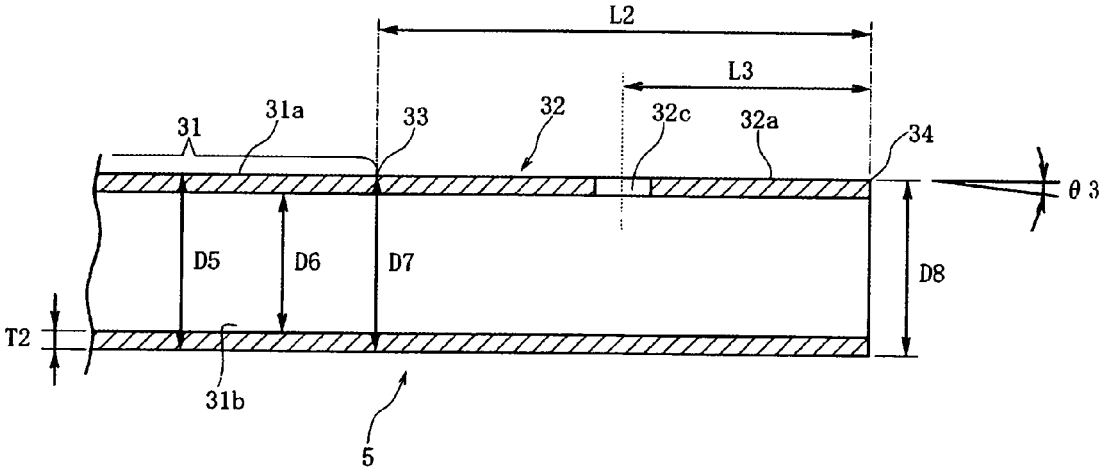
Figure 4:
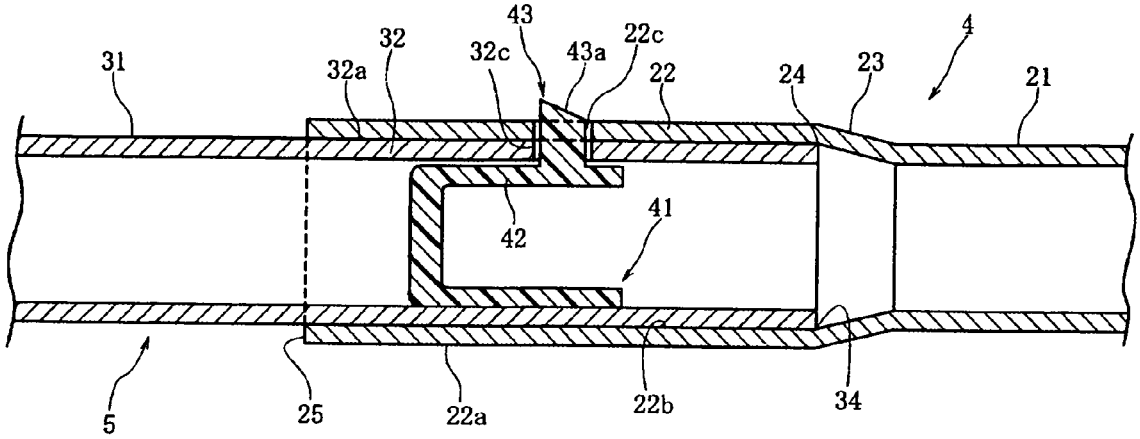
FIG. 4 is a sectional view showing a state where the male coupling fits in the female coupling according to an embodiment of the invention.

FIG. 1 is a perspective view of a cleaning device employing a pipe handle according to one embodiment of the present invention; FIG. 2 is an exploded perspective view showing a connection of the pipe handle; FIG. 3(A) is a sectional view of a female coupling of a first pipe; FIG. 3(B) is a sectional view of a male coupling of a second pipe; and FIG. 4 is a sectional view showing a state where the male coupling fits in the female coupling.

FIG. 1 shows a cleaning device 1 which is suitable for cleaning the house floor and composed of a pipe handle 2, a head 3 connected to a front end of the pipe handle 2 and a grip 16 attached to a rear end of the pipe handle 2.

The pipe handle 2 may be constructed by coupling four short pipes, i.e., a rear-side end pipe 4, a rear-side intermediate pipe 5, a front-side intermediate pipe 6 and a front-side end pipe 7. In FIG. 1, the rear-side end pipe 4 and the rear-side intermediate pipe 5 are coupled together at a connection 8, the rear-side intermediate pipe 5 and the front-side intermediate pipe 6 are coupled together at a connection 9, and the front-side intermediate pipe 6 and the front-side end pipe 7 are coupled together at a connection 10. The head 3, which is connected to the front end of the long pipe handle 2 constructed by coupling these pipes, can be slid on a floor surface by holding the grip 16. When not in use, the cleaning device 1 may be stored compactly by uncoupling the pipes.

The head 3 may be rectangular in plan configuration and may have a top face which is centrally connected to the front end of the front-side end pipe 7 through a universal joint 11. To the head 3, a cleaning sheet 12 may be attached for cleaning. The cleaning sheet 12 may be a disposable wiper constructed mainly of a nonwoven fabric and capable of absorbing liquid. The cleaning sheet 12 may be laid on a bottom face of the head 3 and partially folded back against the top face of the head 3 and detachably fixed on the top face of the head 3 by fixing means (not shown).

A holder 13 may be fixed on the front-side intermediate pipe 6 with an opening directed upward so that a container 14 filled with liquid can be put in the holder 13. The grip 16 has a push button 15. By pushing the push bottom 15, a valve of the holder 13 may be opened to let the liquid inside the container 14 flow down a tube passing through the front-side intermediate pipe 6 and the front-side end pipe 7 and the liquid may be squirted from a nozzle of the head 3 and applied to the floor surface in front of the head 3.

The grip 16 may be made of a synthetic resin and secured on the rear end of the rear-side end pipe 4.

At the connections 8, 9, 10, two pipes may be coupled in the same manner. Therefore, only the structure of the connection 8 where the rear-side end pipe 4 and the rear-side intermediate pipe 5 are coupled will be described hereinbelow with reference to FIGS. 2 to 4. In the embodiment of FIGS. 2 to 4, the rear-side end pipe 4 has a female coupling and is called "first pipe" and the rear-side intermediate pipe 5 has a male coupling and is called "second pipe". Alternatively, the rear-side end pipe 4 may have a male coupling and be called "second pipe" and the rear-side intermediate pipe 5 may have a female coupling and be called "first pipe". This relationship is also true in the connections 9 and 10.

The first pipe 4 of FIG. 3(A) and the second pipe 5 of FIG. 3(B) may be cylinders of aluminum or aluminum alloy, whose inner and outer surfaces are both circular in section taken on a plane perpendicular to the pipe axis. Alternatively, the first pipe 4 and the second pipe 5 may be made of copper alloy, brass alloy, stainless steel, etc. These pipes are preferably made of any one of the above-mentioned metals from the viewpoint of strength, although they may also be made of a synthetic resin.

As shown in FIG. 3(A), the first pipe 4 has a main body 21 and a female coupling 22 projecting forward from a front end of the main body 21 to have a length L1. Between the main body 21 and the female coupling 22, there may be provided an intermediate part 23 for forming a step between an inner surface 21*b* of the main body 21 and an inner surface 22*b* of the female coupling 22. In the main body 21, an outer surface 21*a* has an outside diameter D1 and the inner surface 21*b* has an inside diameter D2. The main body 21 has a wall thickness T1. The outside diameter D1 may be about 10 to 50 mm and the wall thickness T1 may be about 1 to 5 mm.

The female coupling 22 and the intermediate part 23 may be formed by diametrically expanding a pipe material having the same diameter as the main body 21. The female coupling 22 has an inside diameter D3 at a boundary 24 between the female coupling 22 and the intermediate part 23 and an inside diameter D4 at a distal end 25, wherein the inside diameter D4 may be equal to or slightly larger than the inside diameter D3. In the case where D4>D3, an angle θ1 between the inner surface 22*b* of the female coupling 22 and the inner surface 21*b* of the main body 21 is equal to or less than 0 degrees 50 minutes in the sectional view of FIG. 3(A). That is, $0° \leqq \theta 1 \leqq 0°50'$.

In the intermediate part 23, the inside diameter gradually increases from a boundary 26 between the intermediate part 23 and the main body 21 to the boundary 24. That is, the intermediate part 23 has a tapered inner surface 23*b*. An angle θ2 between the inner surface 23*b* of the intermediate part 23 and the inner surface 21*b* of the main body 21 is sufficiently larger than the angle θ1 and in the range of 10° to less than 90°.

As shown in FIG. 3(B), the second pipe 5 has a main body 31 and a male coupling 32 projecting rearward from a rear end of the main body 31 to have a length L2. The length L2 of the male coupling 32 may be equal to the length L1 of the female coupling 22 or shorter than the length L1 by about 0.5 to 5 mm.

The main body 31 has an outer surface 31*a*, whose outside diameter D5 is equal to or almost equal to the outside diameter D1 of the main body 21 of the first pipe 4, and an inner surface 31*b*, whose inside diameter D6 is equal to or almost equal to the inside diameter D2 of the main body 21 of the first pipe 4. The main body 31 has a wall thickness T2, which is equal to or almost equal to the wall thickness T1 of the main body 21 of the first pipe 4. Accordingly, the second pipe 5 may be formed of a pipe material having the same nominal size as that used for the first pipe 4.

The male coupling 32 has an outer surface 32*a*. The outer surface 32*a* has an outside diameter D7 at a boundary 33 between the male coupling 32 and the main body 31 and an outside diameter D8 at a distal end 34. According to a first embodiment, the outside diameter D7 may be equal to the outside diameter D8 and also equal to the outside diameter D5 of the main body 31. That is, the outer surface 31*a* of the main body 31 and the outer surface 32*a* of the male coupling 32 may have a constant outside diameter without processing the male coupling 32 to vary the diameter.

According to a second embodiment, the outside diameter D7 at the boundary 33 may be equal to the outside diameter D5 but the outside diameter D8 at the distal end 34 may be slightly smaller than the outside diameter D7. This may be achieved by diametrically contracting the pipe material or polishing the outside surface 32*a*. More specifically, the outside surface 32*a* of the male coupling 32 may be so tapered that the outside diameter gradually decreases toward the distal end 34. In this case, an angle θ3 between the outside surface 31*a* of the main body 31 and the outside surface 32*a* of the male coupling 32 is equal to or less than 0°50' in the sectional view of FIG. 3(B). According to the first and second embodiments, therefore, $0° \leqq \theta 3 \leqq 0°50'$. In either embodiment, there is no step between the outer surface 31*a* of the main body 31 and the outer surface 32*a* of the male coupling 32.

When the outer surface 32*a* of the male coupling 32 has a constant diameter according to the first embodiment, the angle θ1 of the female coupling 22 is preferably 0° or almost 0°. This prevents wobbling of the first and second pipes 4, 5 at the connection 8.

When the outer surface 32*a* of the male coupling 32 is tapered according to the second embodiment, on the other hand, the angle θ1 of the female coupling 22 may fall within the range between 0° and 0°50'. In this case, however, the angle θ3 of the outer surface 32*a* of the male coupling 32 is preferably equal to or almost equal to the angle θ1 of the inner surface 22*b* of the female coupling 22. Most preferably, the angle θ1 is equal to the angle θ3.

By minimizing the angular difference between the outer surface 32*a* of the male coupling 32 and the inner surface 22*b* of the female coupling 22 with respect to the pipe axis, as set forth above, the outer surface 32*a* of the male coupling 32 can fit with minimum clearance against the inner surface 22*b* of the female coupling 22 to thereby prevent wobbling at the connection 8.

In order that the male coupling 32 will closely fit in the female coupling 22, as set forth above, the outside diameter D8 at the distal end 34 of the male coupling 32 is preferably equal to or slightly smaller than the inside diameter D3 at the boundary 24 of the first pipe 4. Also, the outside diameter D7 at the boundary 33 of the second pipe 5 is preferably equal to or slightly smaller than the inside diameter D4 at the distal end 25 of the female coupling 22.

As shown in FIG. 3(A), the female coupling 22 may have an engaging hole 22*c*, which is spaced a distance L3 apart from the boundary 24 toward the distal end 25, and the male coupling 32 may have an engaging hole 32*c*, which is spaced the same distance L3 apart from the distal end 34 toward the boundary 33. The engaging hole 22*c* and the engaging hole 32*c* may have the same opening diameter.

Inside the male coupling 32 of the second pipe 5, an engaging member 41 may be provided as shown in FIG. 4. The engaging member 41 may be made of a synthetic resin material or a resiliently deformable metal material and may be integrally formed with an engaging projection 43 on an outer surface of a resiliently deformable part 42. The engaging projection 43 may have a slope 43*a* declining toward the distal end 34 of the male coupling 32 to have a minimum height equal to or greater than the sum of the wall thickness T1 and the wall thickness T2.

When the first pipe 4 and the second pipe 5 are separated from each other, as shown in FIG. 2, the slope 43*a* of the engaging projection 43, which is fitted in the engaging hole 32*c* of the male coupling 32 from the inside, projects from the outer surface 32*a* of the male coupling 32.

When the male coupling 32 of the second pipe 5 is inserted into the female coupling 22 of the first pipe 4, the resiliently deformable part 42 may be deformed toward the inside of the male coupling 32 by contact of the slope 43*a* of the engaging projection 43 with the distal end 25 of the female coupling 22 so that the engaging projection 43 may slide on the inner surface 22*b* of the female coupling 22. The extent of insertion of the male coupling 32 may be limited by contact of the distal end 34 of the male coupling 32 with the inner surface 23*b* of the intermediate part 23 of the first pipe 4 or the boundary 24. After insertion, the resiliently deformable part 42 may recover to the original state when the engaging projection 43 is aligned with the engaging hole 22*c* of the female coupling 22, so that the engaging projection 43 fits in the engaging hole 22*c* of the female coupling 22, as shown in FIG. 4. Thus, coupling between the first pipe 4 and the second pipe 5 can be maintained.

It should be noted that the engaging projection 43 may be disengaged from the engaging hole 22*c* by depressing the engaging projection 43, which projects from the outer surface of the female coupling 22 in the engaging state of FIG. 4. Thus, the first pipe 4 and the second pipe 5 may be separated from each other.

In the connections 8, 9, 10, as has been described hereinabove, the first pipe 4, whose female coupling 22 is formed by diametrically expanding the pipe material, does not have a portion having a smaller diameter than the main body 21 and the second pipe 5, whose outer surface is continuous without any step between the male coupling 32 and the main body 31, has a constant or almost constant diameter. Therefore, the connections 8, 9, 10 are prevented from being subjected to excess stress due to bending moment and are increased in strength against the bending moment. Thus, even if the cleaning sheet 12 attached to the head 3 is strongly pressed against the floor surface by holding the grip 16 of FIG. 1 in hand, deformation of the pipe handle 2 at the connections 8, 9, 10 can be effectively prevented.

In addition, the outer surface 32*a* of the male coupling 32 of the second pipe 5 is not processed to vary the diameter, or even if the outer surface 32*a* is tapered, its gradient is extremely slight. Therefore, the size and shape of the outer surface 32*a* of the male coupling 32 do not vary widely. Furthermore, since the female coupling 22 of the first pipe 4 is formed by diametrically expanding the pipe material, the size and shape of the inner surface 22*b* do not vary widely. Hence, when the male coupling 32 is inserted into the female coupling 22, as shown in FIG. 4, the outer surface 32*a* can fit with minimum clearance against the inner surface 22*b* to thereby prevent wobbling at the connections 8, 9, 10.

The engaging member 41, which is provided inside the male coupling 32, can be easily fitted in the engaging hole 22*c* of the female coupling 22 only by inserting the male coupling 32 into the female coupling 22 and aligning the engaging hole 22*c* with the engaging hole 32*c*. This arrangement also facilitates disengagement of the engaging member 41 from the engaging hole 22*c*.

The pipe handle 2 may have a constant outside diameter except for the connections 8, 9, 10, which results in improving the appearance and providing an almost uniform strength throughout the length of the pipe handle 2.

Although the present invention has been illustrated and described with respect to exemplary embodiment thereof, it should be understood by those skilled in the art that the foregoing and various other changes, omission and additions may be made therein and thereto, without departing from the spirit and scope of the present invention. For example, the cleaning device may be adapted for cleaning a ceiling or wall. The number of pipes constituting the pipe handle may be two or three or five or more. The section of the pipe may be oval or elliptical, instead of circular.

Therefore, the present invention should not be understood as limited to the specific embodiments set out above but should be understood to include all possible embodiments which can be embodied within a scope encompassed and equivalent thereof with respect to the feature set out in the appended claims.

What is claimed is:

1. A pipe handle, comprising:

a first pipe formed of a metal pipe material, comprising:

a main body;

a female coupling defining a first engaging hole; and an intermediate part located between the main body and the female coupling, providing a step between an inner surface of the main body and an inner surface of the female coupling;

wherein said first engaging hole is located a first distance from said intermediate part:

a second pipe engaging with the first pipe, the second pipe formed by diametrically expanding a metal pipe material that is the same as the metal pipe material of the first pipe, the second pipe comprising:

a main body having an outside diameter equal or almost equal to an outside diameter of the main body of the first pipe; and a male coupling adjacent to the main body, having an outer surface continuous with an outer surface of the main body without any step therebetween, the male coupling loosely fitting into the female coupling of the first pipe, said male coupling defining a second engaging hole located a second distance from the distal end of said male coupling, which second distance is equal to said first distance; and an engaging member located inside the male coupling of the second pipe, said engaging member comprising a U-shaped member consisting of two legs, each of which extend parallel to a longitudinal axis of the second pipe and adjacent to an internal surface of the second pipe, wherein each of said legs are connected at an end to the other leg by a transverse connecting member that is substantially perpendicular to said two legs, said engaging member also including an engaging projection configured to project through said first and second engaging holes to extend beyond an outer surface of said female coupling when said first and second pipe are connected, said engagement projection having a flat top surface, the top of which slope surface declines toward a distal end of the male coupling, wherein the outer surface of the male coupling is a tapered outer surface whose outside diameter gradually decreases from a boundary between the main body of the second pipe and the male coupling to a distal end of the male coupling, and an angle foamed between the tapered outer surface of the male coupling and the outer surface of the main body is equal to or less than 0°50', the inner surface of the female coupling is a tapered inner surface whose inside diameter gradually increases from a boundary between the intermediate part and the female coupling to a distal end of the female coupling, and an angle formed between the tapered inner surface of the female coupling and the inner surface of the main body of the first pipe is equal to or less than 0°50', and the intermediate part has a tapered inner surface whose inside diameter gradually increases from a boundary between the main body of the first pipe and the intermediate part to the boundary between the intermediate part and the female coupling, and an angle formed between the tapered inner surface of the intermediate part and the inner surface of the main body is larger than the angle formed between the inner surface of the female coupling and the inner surface of the main body, and wherein a length of the female coupling from the boundary between the intermediate part and the female coupling to the distal end of the female coupling is larger than a length of the male coupling from the boundary between the main body and the male coupling to the distal end of the male coupling, the length of the male coupling is larger than twice of the outside diameter of the main body of the first pipe or the outside diameter of the main body of the second pipe, the outside diameter of the main body of the first pipe is larger than an outside diameter of the distal end of the male coupling, and the outside diameter of the distal end of the male coupling is larger than an inside diameter of the main body of the first pipe.

2. A cleaning device comprising the pipe handle of claim 1 and a head connected to one end of the pipe handle for attachment of a cleaning sheet.

* * * * *